United States Patent [19]

Yagi et al.

[11] Patent Number: 4,923,773

[45] Date of Patent: May 8, 1990

[54] MULTILAYERED ELECTROPHOTOGRAPHIC PHOTORECEPTOR OF AMORPHOUS SILICON HAVING A SURFACE LAYER OF NITROGENATED AMORPHOUS SILICON

[75] Inventors: Shigeru Yagi; Masato Ono; Noriyoshi Takahashi; Masayuki Nishikawa; Yuzuru Fukuda; Kenichi Karakida, all of Kanagawa, Japan

[73] Assignee: Fuji Xerox Co., Ltd., Tokyo, Japan

[21] Appl. No.: 259,238

[22] Filed: Oct. 18, 1988

[51] Int. Cl.[5] ..... G03G 5/14

[52] U.S. Cl. ..... 430/57; 430/85; 430/65; 430/66

[58] Field of Search ..... 430/58, 65, 66, 67, 430/57

[56] References Cited

U.S. PATENT DOCUMENTS

| | | | |
|---|---|---|---|
| 4,634,647 | 1/1987 | Jansen et al. | 430/95 |
| 4,775,606 | 10/1988 | Shirai | 430/67 |
| 4,795,691 | 1/1989 | Takei et al. | 430/67 |

FOREIGN PATENT DOCUMENTS 60-112048 6/1985 Japan .

*Primary Examiner*—J. David Welsh

*Attorney, Agent, or Firm*—Finnegan, Henderson, Farabow, Garrett and Dunner

[57] ABSTRACT

An electrophotographic photoreceptor comprising a support, a charge blocking layer, a first photoconductive layer composed of at least amorphous silicon, a second photoconductive layer composed of at least boron-containing amorphous silicon, a surface layer composed of at least nitrogenated amorphous silicon, the surface layer having an interface for contacting the second photoconductive layer, the surface layer including a lower region corresponding to an area not greater than approximately 100 Å away from the interface, the lower region having a ratio of not less than 0.5 parts of nitrogen atoms for one part of silicon atoms, the nitrogen ratio of the lower region and the boron content of the second photoconductive layer corresponding to the relation $B \geqslant 10^{(9N-5.5)}$ where B is the boron content in PPM and N is the ratio of nitrogen atoms to silicon atoms.

18 Claims, 1 Drawing Sheet

MULTILAYERED ELECTROPHOTOGRAPHIC PHOTORECEPTOR OF AMORPHOUS SILICON HAVING A SURFACE LAYER OF NITROGENATED AMORPHOUS SILICON

FIELD OF THE INVENTION

The present invention relates to electrophotographic photoreceptor.

BACKGROUND OF THE INVENTION

Recently, various kinds of electrophotographic photoreceptor having a amorphous silicon light-sensitive layer on a support have been proposed. This type of electrophotographic photoreceptor typically has excellent mechanical strength, panchromatic properties and long-wavelength sensitivity. To further improve electrophotographic characteristics, several types of electrophotographic photoreceptor have been proposed. One of such proposal is a separated-function type material that is formed by functionally separating the photoconductive layer into a charge-generation layer and a charge-transport layer. Another such proposal is for material having a surface layer applied to a light-sensitive layer containing boron. (For example, refer to Japanese Patent Unexamined Publication No. 60-112048.)

The electrophotographic characteristics of the conventionally-proposed material having a amorphous silicon light-sensitive layer and a surface layer applied on the light-sensitive layer, vary widely according to the quality of the surface layer and boron concentration. When a surface layer is applied on the amorphous silicon light-sensitive layer, image flow often occurs in the copy image, particularly when the surface layer is composed of a nitrogenated amorphous silicon film. This problem has not yet been solved and often leads to unsatisfactory results.

SUMMARY OF THE INVENTION

An object of the present invention is an electrophotographic photoreceptor that avoids the problems in the prior art.

Another object of the present invention is an electrophotographic photoreceptor that has a surface layer composed of nitrogen-containing amorphous silicon.

A further object of the present invention is an electrophotographic photoreceptor having excellent electrophotographic characteristics in dark decay, sensitivity and electrification to eliminate image flow and blur in copy images.

Still a further object of the present invention is an electrophotographic photoreceptor wherein the boron content of a light-sensitive layer and the nitrogen content of a surface layer directly relate to the quality of the copy image obtained.

These and other objects are obtained by an electrophotographic photoreceptor comprising a support having a contact surface portion, a plurality of laminated layers overlaying the contact surface portion including a charge blocking layer, a first photoconductive layer composed of at least amorphous silicon, a second photoconductive layer composed of at least boron-containing amorphous silicon, a surface layer composed of at least nitrogenated amorphous silicon, the surface layer having an interface for contacting the second photoconductive layer, the surface layer including a lower region corresponding to an area not greater than approximately 100 Å away from the interface, the lower region having a ratio of not less than 0.5 parts of nitrogen atoms for one part of silicon atoms, the nitrogen ratio of the lower region and the boron content of the second photoconductive layer corresponding to the relation $B \geqq 10(9N-5.5)$ where B is the boron content in PPM and N is the ratio of nitrogen atoms to silicon atoms.

DETAILED DESCRIPTION

Figure 1:
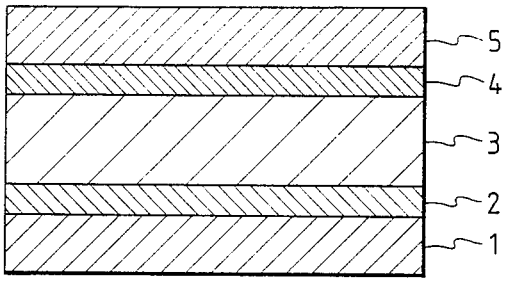
FIG. 1 is a sectional view of an electrophotographic photoreceptor according to the present invention.

According to the present invention, the electrophotographic photoreceptor comprises a support covered by a number of layers including a charge blocking layer, a first photoconductive layer mainly composed of amorphous silicon, a second photoconductive layer composed of boron-containing amorphous silicon, and a surface layer mainly composed of nitrogenated amorphous silicon. The boron-containing amorphous silicon of the second photoconductive layer contains 2 ppm or more of boron. The surface layer is constructed so that the proportion of nitrogen to silicon atoms is at least 0.5 to 1 in the region 100 Å or less away from the interface with the second photoconductive layer. The boron content of the second photoconductive layer and the proportion of nitrogen atoms in a region of the surface layer at a distance of 100 Å or less from the interface with the second photoconductive layer should satisfy the following relation (I):

$$B \geqslant 10(9N-5.5) \qquad (I)$$

in which B is the boron content (ppm) of the second photoconductive layer, and N is the proportion of nitrogen atoms per one part of silicon atoms in the surface layer.

FIG. 1 is a typical sectional view of electrophotographic photoreceptor according to the present invention. In the drawing, the electrophotographic photoreceptor is composed of a support 1, a charge blocking layer 2, a first photoconductive layer 3, a second photoconductive layer 4, and a surface layer 5.

The support may be suitably selected from either electrically conductive or electrically insulating materials. If an electrically insulating support is chosen, it is necessary to treat at least the surface of the support in contact with another layer in order to make it electrically conductive. Examples of electrically conductive supports include metals such as stainless steel, aluminum and the like, as well as alloys. Examples of electrically insulating supports include film or sheet supports of synthetic resin, such as polyester, polyethylene, polycarbonate, polystyrene, polyamide and the like, as well as glass, ceramic, and paper supports.

A charge blocking layer is provided on the support. The charge blocking layer is preferably composed of noncrystalline silicon containing 50–5000 ppm boron. The thickness of the layer preferably ranges from about 0.5 μm to about 10 μm.

The first photoconductive layer is formed on the charge blocking layer. It is mainly composed of amorphous silicon which, if necessary, contains at least one doping element, such as boron. When boron is used as a doping element, the preferred boron content ranges from about 0 to 3 ppm. The thickness of the first photoconductive layer ranges from about 1 μm to 100 μm.

The second photoconductive layer is formed on the first photoconductive layer. It is composed of boron-containing amorphous silicon. It is necessary for the boron content of the boron-containing amorphous silicon to be not less than 3 ppm, and preferably within a range of 5 ppm to 400 ppm. If the boron content is less than 3 ppm, the copy image obtained becomes unsatisfactory. The thickness of the second photoconductive layer ranges from 0.1 μm to 10 μm.

The charge blocking layer, first photoconductive layer and second photoconductive layer can each be formed by glow-discharge decomposition. One method of glow-discharge decomposition is carried out by introducing a raw-material gas into an apparatus containing a plasma chemical vapor deposition (plasma CVD) and a support. The raw-material gas can be formed by mixing a necessary quantity of diborane ($B_2H_6$) gas in a silane gas selected from silane or its derivatives. Examples of silane and its derivatives are $SiH_4$, $Si_2H_6$, $SiCl_4$, $SiHCl_3$, $SiH_2Cl_2$, $Si(CH_3)_4$, $Si_3H_8$, and $Si_4H_{10}$. In this case, a hydrogen gas may be introduced with the silane gas.

When AC discharge is considered as an example, the film-forming conditions are suitably selected from the following ranges: frequency within a range of 50 Hz to 5 GHz, reactor inside pressure within a range of from $10^{-4}$ Torr to 5 Torr, discharge electric power within a range of 10 W to 2000 W, and support temperature within a range of 30° C. to 300° C.

The surface layer provided on the second photoconductive layer is composed of nitrogenated amorphous silicon. It is necessary for the proportion of nitrogen atoms in the surface layer to be 0.5 or more parts of nitrogen atoms per one part of silicon atoms. If the proportion of nitrogen atoms to silicon atoms is less than 0.5, the sensitivity of the electrophotographic photoreceptor to short-wavelength light is reduced.

The surface layer may have a monolayered structure in which the nitrogen concentration is uniform throughout the entire layer or the concentration may be gradient. The surface layer may also have a multilayered structure consisting of a plurality of nitrogenated amorphous silicon layers with varying nitrogen concentrations. However, there are two minimum requirements. The first requirement is that the proportion of nitrogen atoms in a region 100 Å or less away from the interface with the second photoconductive layer is 0.5 or more parts per one part of silicon atoms. The second requirement is that the boron content of the second photoconductive layer and the proportion of nitrogen atoms in the region of the surface layer at 100 Å or less away from the interface with the second photoconductive layer satisfy the aforementioned relation (I).

The surface layer is formed by glow-discharge decomposition through the introduction of a raw-material gas into an apparatus of plasma CVD in the same manner as was previously described. In this case, a silane gas and an ammonia gas are used as a raw-material gas. The flow-rate of the ammonia gas to the silane gas is controlled so that the proportion of nitrogen atoms to silicon atoms of the surface layer being prepared can be established to be not less than 0.5.

When AC discharge is considered as an example, the other film-forming conditions are suitably selected from the following ranges: frequency within a range of 50 Hz to 5 GHz, reactor inside pressure within a range of $10^{-4}$ Torr to 5 Torr, and discharge electric power within a range of from 10 W to 2000 W. The thickness of the surface layer ranges from about 0.1 μm to 10 μm.

In the present invention, it is necessary for the boron content of the second photoconductive layer and the nitrogen content of the surface layer to satisfy the aforementioned relation (I). The relation has been determined based upon the results of experiments conducted to predict the quality of the copy image obtained. If the relationship between the boron content of the second photoconductive layer and the nitrogen content of the surface layer is outside the limitations of the aforementioned relation (I), image flow or blur occurs in the copy image.

The following examples serve to illustrate the preferred embodiments of the present invention.

EXAMPLE 1

A charge blocking layer with a thickness of about 4 μm was formed on a cylindrical aluminum support by glow-discharge decomposition of a mixture of a silane ($SiH_4$) gas and a diborane ($B_2H_6$) gas. The layer was formed in a capacitive-coupling plasma CVD apparatus capable of producing a amorphous silicon film on the cylindrical support. The film-forming conditions were as follows:

Flow rate of 100% silane gas: 150 $cm^3$/min
Flow rate of 200 ppm hydrogen-diluted diborane gas: 150 $cm^3$/min
Reactor inside pressure: 0.5 Torr
Discharge electric power: 200 W
Discharge time: 1 hr
Discharge frequency: 13.56 MHz
Support temperature: 250° C.

After the formation of th charge clocking layer, a first photoconductive layer with a thickness of about 20 μm was formed on the charge blocking layer. This layer was formed by the glow-discharge decomposition of a mixture of a silane gas and a diborane gas introduced into a reactor. The film-forming conditions were as follows:

Flow rate of 100% silane gas: 200 $cm^3$/min
Flow rate of 100 ppm hydrogen-diluted diborane gas: 4 $cm^3$/min
Reactor inside pressure: 0.8 Torr
Discharge electric power: 200 W
Discharge time: 4 hr
Discharge frequency: 13.56 MHz
Support temperature: 250° C.

The resulting boron content of the first photoconductive layer formed was 2 ppm.

After the formation of the first photoconductive layer, the gas within the reactor was sufficiently exhausted. Then a second photoconductive layer with a thickness of about 1 μm was formed on the first photoconductive layer. This layer was formed by the glow-discharge decomposition of a mixture of a silane gas and a diborane gas introduced into the reactor. The film-forming conditions were as follows:

Flow rate of 100% silane gas: 200 $cm^3$/min
Flow rate of 100 ppm hydrogen-diluted diborane gas: 20 $cm^3$/min
Reactor inside pressure: 0.8 Torr
Discharge electric power: 200 W
Discharge time: 12 min
Discharge frequency: 13.56 MHz
Support temperature: 250° C.

The resulting boron content of the second photoconductive layer formed was 10 ppm.

After the formation of the second photoconductive layer, the gas within the reactor was sufficiently exhausted. Then a surface layer with a thickness of about 0.3 μm was formed on the second photoconductive layer by the glow-discharge decomposition of a mixture of a silane gas, a hydrogen gas, and an ammonia gas introduced into the reactor. The film-forming conditions were as follows:

Flow rate of 100% silane gas: 25 $cm^3$/min
Flow rate of 100% hydrogen gas: 100 $cm^3$/min
Flow rate of 100% ammonia gas: 35 $cm^3$/min
Reactor inside pressure: 0.5 Torr
Discharge electric power: 50 W
Discharge time: 1 hr
Discharge frequency: 13.56 MHz
Support temperature: 250° C.

The proportion of nitrogen atoms to silicon atoms, of the surface layer was 0.65.

The electrophotographic photoreceptor was then electrified with the surface potential of +500 V at 20° C. and 15%RH. It was then exposed to light to reproduce an image. This resulted in a half-decay exposed E50 of 5 erg/$cm^2$ in the wavelength of 600 nm and a rest potential of +10 V. The image obtained had excellent resolving power (7 lp/mm).

EXAMPLES 2 AND 3 AND COMPARATIVE EXAMPLES 1 TO 4

In each of the examples and comparative examples, a charge blocking layer and a first photoconductive layer were formed in the same manner as in Example 1. Then a second photoconductive layer was formed in the same manner as in Example 1 except that the quantity of diborane gas introduced was changed as shown in Table 1. A surface layer was then formed in the same manner as in Example 1, except that the quantities of ammonia gas and silane gas were changed as shown in Table 1. Each sample of electrophotographic photoreceptor formed was used to reproduce a copy image. The results are shown in Table 1.

In Comparative Examples 3 and 4 electrophotographic photoreceptor was produced without the first photoconductive layer as a third layer. The results are shown in Table 1.

TABLE 1

| | 2nd photoconductive layer | | surface layer | | |
|---|---|---|---|---|---|
| | diborane ($cm^3$/min) | boron content (ppm) | ammonia/silane ($cm^3$/min) | N/Si ratio | Quality of copy image |
| Exmp. 2 | 200 | 100 | 40/20 | 0.8 | Good (7 lp/mm) |
| Exmp. 3 | 800 | 400 | 45/15 | 0.9 | Good (5 lp/mm) |
| Comp. 1 | 20 | 10 | 40/20 | 0.8 | Blur |
| Comp. 2 | 200 | 100 | 45/15 | 0.9 | Severe Blur |
| Comp. 3 | — | — | 35/25 | 0.65 | Bad (3 lp/mm) |
| Comp. 4 | — | — | 40/20 | 0.8 | Severe Blur |

The electrophotographic photoreceptor of the present invention has the following characteristics: the boron-containing amorphous silicon of the second photoconductive layer contains 3 ppm or more boron; the proportion of nitrogen atoms per silicon atoms of the surface layer is 0.5 or more; and the boron content of the second photoconductive layer and the nitrogen content of the surface layer satisfy the aforementioned relation (I). The resulting material has electrophotographic characteristics excellent in dark decay, sensitivity and electrification. Further, image flow or blur does not occur in the copy image obtained.

What is claimed is:

1. An electrophotographic photoreceptor comprising:

a support;

a charge blocking layer;

a first photoconductive layer composed of at least amorphous silicon;

a second photoconductive layer composed of at least boron-containing amorphous silicon;

surface layer composed of at least nitrogenated amorphous silicon, said surface layer having an interface for contacting said second photoconductive layer, said surface layer including a lower region corresponding to an area not greater than approximately 100 Å away from said interface, said lower region having a ratio of not less than 0.5 parts of nitrogen atoms for one part of silicon atoms, said nitrogen ratio of said lower region and the boron content of said second photoconductive layer corresponding to the relation $B \geqslant 10(9N-5.5)$ where B is the boron content in PPM and N is the ratio of nitrogen atoms to silicon atoms.

2. An electrophotographic photoreceptor as set forth in claim 1, wherein said support is made of metal.

3. An electrophotographic photoreceptor as set forth in claim 1, wherein said support is electrically insulative support having an electrically conductive surface.

4. An electrophotographic photoreceptor as set forth in claim 1, wherein said charge blocking layer overlays said support and includes amorphous silicon containing between 50 and 5000 ppm boron and has a thickness of between 0.5 μm and 10 μm.

5. An electrophotographic photoreceptor as set forth in claim 1, wherein said first photoconductive layer overlays said charge blocking layer and has a thickness approximately within the range of about 1 μm to 100 μm.

6. An electrophotographic photoreceptor as set forth in claim 5, wherein said first photoconductive layer contains a doping element.

7. An electrophotographic photoreceptor as set forth in claim 6, wherein said doping element is boron, the proportion of said boron doping element being approximately within the range of 0 to 3 ppm.

8. An electrophotographic photoreceptor as set forth in claim 1, wherein said second photoconductive layer overlays said first photoconductive layer and the boron content of said boron-containing amorphous silicon of said second photoconductive layer is greater than 3 ppm, said second photoconductive layer having an approximate thickness of about 0.1 μm to 10 μm.

9. An electrophotographic photoreceptor as set forth in claim 8, wherein said boron content of said boron containing amorphous silicon of said second photoconductive layer is within the range of approximately 5 ppm to 400 ppm.

10. An electrophotographic photoreceptor as set forth in claim 1, wherein said surface layer has a nitrogen content of at least about 0.5 parts nitrogen to 1 part silicon.

11. An electrophotographic photoreceptor as set forth in claim 10, wherein said surface layer including said lower region is a monolayered structure wherein nitrogen is uniform throughout.

12. An electrophotographic photoreceptor as set forth in claim 10, wherein nitrogen concentration is gradient within said surface layer.

13. An electrophotographic photoreceptor as set forth in claim 1, wherein said charge blocking layer, said first photoconductive layer, said second photoconductive layer and said surface layer are each formed by a method of glow-discharge decomposition.

14. An electrophotographic photoreceptor comprising:

a support;

a charge blocking layer;

a first photoconductive layer composed of at least amorphous silicon;

a second photoconductive layer composed of at least boron containing amorphous silicon; and a surface layer composed of at least nitrogenated amorphous silicon, said surface layer having an interface for contacting said second photoconductive layer, said surface layer having a lower region corresponding to an area not greater than 100 Å from said interface;

said charge blocking layer overlaying said support, having an approximate thickness between 0.5 μm and 10 μm and being composed of amorphous silicon containing between 50 and 100 ppm boron;

said first photoconductive layer having an approximate thickness of between 1 μm to 10 μm, overlaying said charge blocking layer and further including at least one doping element, said at least one doping element having between 0 and 3 ppm of boron;

said second photoconductive layer having an approximate thickness of between 0.1 μm and 10 μm, overlaying said first photoconductive layer and having a boron content of between 5 and 400 ppm;

said lower region of said surface layer having 0.5 parts nitrogen atoms for each part silicon, said nitrogen content of said lower region and the boron content of said second photoconductive layer corresponding to the relation $B \geqq 10(9N-5.5)$ where B is the boron content of PPM, and N is the ratio of nitrogen atoms to silicon atoms.

15. An electrophotographic photoreceptor as set forth in claim 14, wherein said charge blocking layer, said first photoconductive layer, and said second photoconductive layer are each formed through a method of glow discharge decomposition, said method of glow discharge decomposition including the step of introducing a raw-material gas into an apparatus of plasma CVD and a support, said raw-material gas including a quantity of diborane gas and a silane gas derivative.

16. An electrophotographic photoreceptor as set forth in claim 15, wherein said silane gas derivative comprises at least one of $SiH_4$, $Si_2H_6$, $SiCl_4$, $SiHCL_3$, $SiH_2Cl_2$, $Si(CH_3)_4$, $Si_3H_8$, and $Si_4H_{10}$.

17. An electrophotographic photoreceptor as set forth in claim 15, wherein hydrogen gas is introduced into said apparatus with said silane gas derivative.

18. An electrophotographic photoreceptor as set forth in claim 14, wherein said surface layer is formed through a method of glow-discharge decomposition, said method of glow-discharge decomposition including the step of introducing a raw-material gas into an apparatus of plasma CVD and a support, said raw-material gas including a silane gas and an ammonia gas.

* * * * *